United States Patent [19]

Liu et al.

[11] Patent Number: 5,041,007

[45] Date of Patent: Aug. 20, 1991

[54] STRUCTURE OF BUS-BAR TYPE ELECTRICAL CONNECTOR

[75] Inventors: Yun-Yu Liu, Taipei; Jih-Bin Lin, Taipei Hsien, both of Taiwan

[73] Assignee: Pan-International Industrial Corp., Hsin-Tien-Taipei, Taiwan

[21] Appl. No.: 594,567

[22] Filed: Oct. 9, 1990

[51] Int. Cl.[5] ..... H01R 4/24

[52] U.S. Cl. ..... 439/404; 439/452

[58] Field of Search ..... 439/395-407, 439/422, 723-725, 452

[56] References Cited

U.S. PATENT DOCUMENTS

| | | | |
|---|---|---|---|
| 4,296,989 | 10/1981 | Larson et al. | 439/404 |
| 4,359,257 | 11/1982 | Lopinski et al. | 439/405 |
| 4,431,248 | 2/1984 | Huntley et al. | 439/405 |
| 4,669,801 | 6/1987 | Worth | 439/404 |
| 4,869,685 | 9/1989 | Alsson | 439/404 |
| 4,891,019 | 1/1990 | Olsson | 439/404 |
| 4,897,041 | 1/1990 | Heiney et al. | 439/404 |

*Primary Examiner*—David L. Pirlot

*Attorney, Agent, or Firm*—Fleit, Jacobson, Cohn, Price, Holman & Stern

[57] ABSTRACT

A base-bar type electrical connector, comprised of a base, an electrical contact assembly, a ribbon cable fastener and a stress eliminator. The electrical contact assembly is comprised of a plurality of conductors fastened in the base at the bottom with forked terminals projecting over the top surface of the base so that a ribbon cable can be placed thereon and squeezed by the ribbon cable fastener to force the forked terminals to pierce through the ribbon cable permitting the conductors in the ribbon cable to electrically retained at the fork of the forked terminals. The stress eliminator has two hook portions respectively hooked up with the base at two opposite ends so as to firmly secure the ribbon cable fastener to the base against any possible stress. The base has a dovetail groove at the bottom conveniently for mounting on a bus-bar main track through dovetail joint to electrically connect the ribbon cable to a bus-bar.

1 Claim, 3 Drawing Sheets

STRUCTURE OF BUS-BAR TYPE ELECTRICAL CONNECTOR

BACKGROUND OF THE INVENTION

The present invention is related to electrical connectors and more particularly to a bus-bar type electrical connector which is comprised of a base, an electrical contact assembly, a ribbon cable fastener and a stress eliminator, and which can be conveniently installed to electrically connect a ribbon cable to a bus-bar without the use of any additional fastening means.

A bus-bar system is a device used to gather the electric circuits of various operational units into a signal transmission main track (bus-bar). The control unit which controls the various operational units is generally connected to a signal transmission main track by an auxiliary transmission track, i.e. ribbon cable, via a bus-bar type electrical connector. According to conventional structures, the bus-bar type electrical connector is very complicated and a ribbon cable is very inconvenient to fasten in a bus-bar type electrical connector. Further, it is also very inconvenient to connect a bus-bar type electrical connector to a bus-bar or disconnect therefrom.

SUMMARY OF THE INVENTION

The present invention has been designed under the circumstances in view. It is therefore an object of the present invention to provide a bus-bar type electrical connector for electrically connecting a ribbon cable to a bus-bar, which is simple in structure and convenient to assemble. It is another object of the present invention to provide a bus-bar type electrical connector for electrically connecting a ribbon cable to a bus-bar, which has the means to automatically press a ribbon cable into position for electrical connection. It is still another object of the present invention to provide a bus-bar type electrical connector for electrically connecting a ribbon cable to a bus-bar, which can be conveniently electrically connected to a bus-bar through dovetail joint without the use of any additional fastening means. It is a yet further object of the present invention to provide a bus-bar type electrical connector for electrically connecting a ribbon cable to a bus-bar, which can efficiently eliminate any possible stress when installed.

To achieve the above objects, there is provided a bus-type electrical connector generally comprised of a base, an electrical contact assembly, a ribbon cable fastener and a stress eliminator. The base has transverse grooves and vertical slots for fastening the electrical contact assembly permitting the forked terminals of the electrical contact assembly to project over the top surface of the base so that a ribbon cable can be placed on the forked terminals of the electric contact assembly and squeezed by the ribbon cable fastener to force the forked terminals to pierce through the ribbon cable permitting the conductors in the ribbon cable to electrically respectively retained at the fork of the forked terminals. The stress eliminator has two hook portions respectively hooked up with the base at two opposite ends so as to firmly secure the ribbon cable fastener to the base and protect the connection of the ribbon cable with the forked terminals of the electrical contact assembly against any possible stress. The base has a dovetail groove at the bottom conveniently for mounting on a bus-bar main track through dovetail joint to electrically connect the ribbon cable to a bus-bar.

BRIEF DESCRIPTION OF THE DRAWINGS

The present invention will now be described by way of example, with reference to the annexed drawings, in which.

Figure 1:
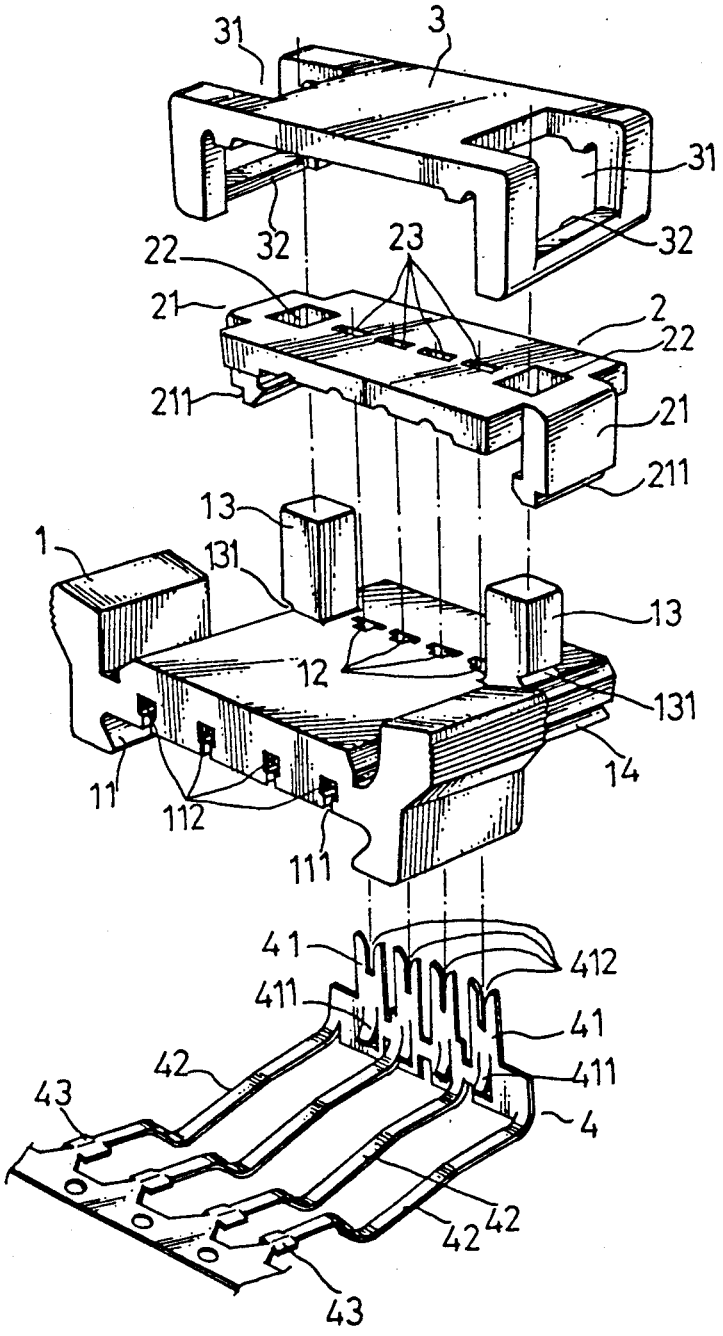
FIG. 1 is a perspective exploded view of the preferred embodiment of the present invention.

DETAILED DESCRIPTION OF THE PREFERRED EMBODIMENT:

Attention is now directed to detailed description of the drawings. FIG. 1 illustrates a bus-bar type electrical connector embodying the present invention and generally comprised of a base 1, a ribbon cable fastener 2, a stress eliminator 3 and an electrical contact assembly 4. The base 1 has a dovetail groove 11 at the bottom side, designed in shape according to the configuration of the bus-bar to connect, with a plurality of elongated grooves 111 made thereon and longitudinally disposed in parallel with one another. On the top surface of the base 1, there are provided a row of slots 12 defined within two opposite supports 13. The ribbon cable fastener 2 which is designed to fit the base 1 comprises two opposite openings 22 at the top, which are designed in size and locations corresponding to the two opposite supports 13 of the base, a plurality of holes 23 at locations corresponding to the slots 12 on the base 1, two opposite hook portions 21 extending downward therefrom at two opposite ends, which have each a cut 211 transversely made on its outer wall surface at the bottom. The stress eliminator 3 is substantially a M-shaped block, having two openings 31 at the two opposite ends thereof and defining therewith two opposite hook portions 32 transversely disposed at the bottom. The electrical contact assembly 4 is integrally comprised of a plurality of conductors each of which comprises an elongated, curved, conductive spring plate 42 terminating in a forked end 41 which is disposed in a vertical position. In the present embodiment, the electrical contact assembly 4 is comprised of four conductors incorporated in parallel with one another. Therefore, the quantity of the elongated grooves 111, the slots 12 and the holes 23 should be the same as the conductors, i.e. four each.

Figure 2:
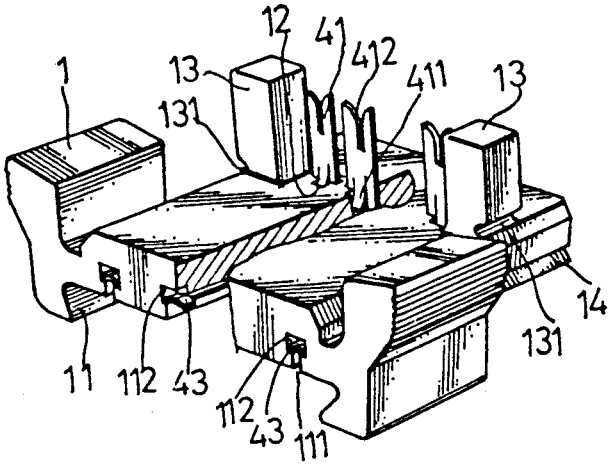
FIG. 2 is a perspective schematic drawing illustrating the connection of the electrical contact assembly with the base.
Figure 3:
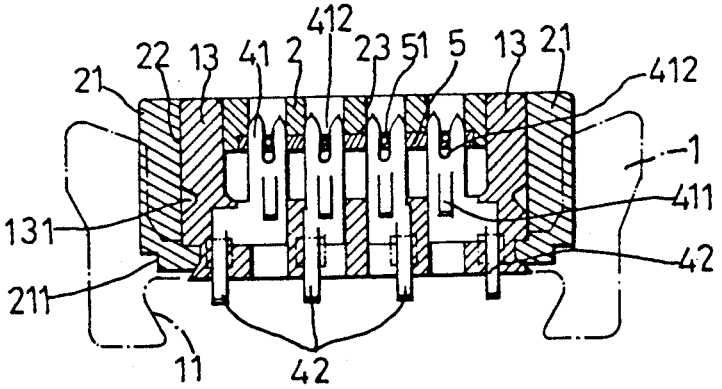
FIG. 3 is a transversr cross sectional view illustrating the connection of a ribbon cable with the electrical contact assembly.
Figure 4:
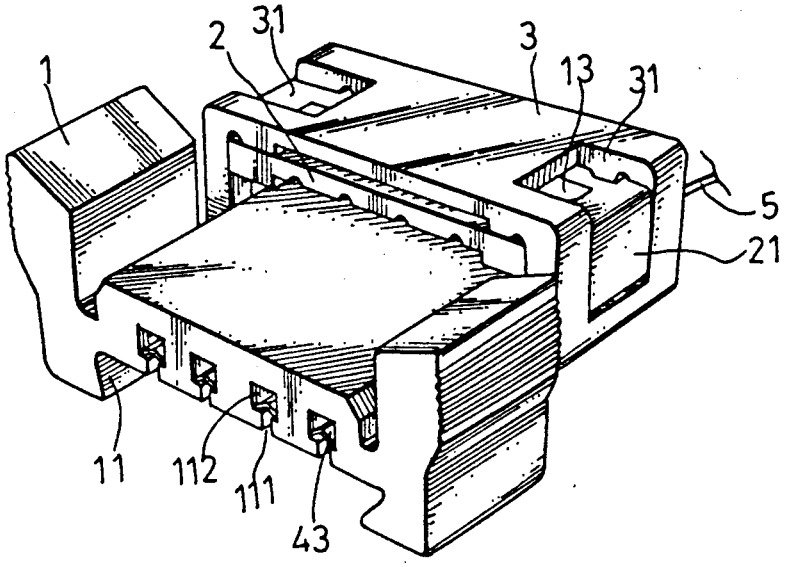
FIG. 4 is a perspective schematic drawing illustrating the connection of the ribbon cable fastener with the base.
Figure 5:
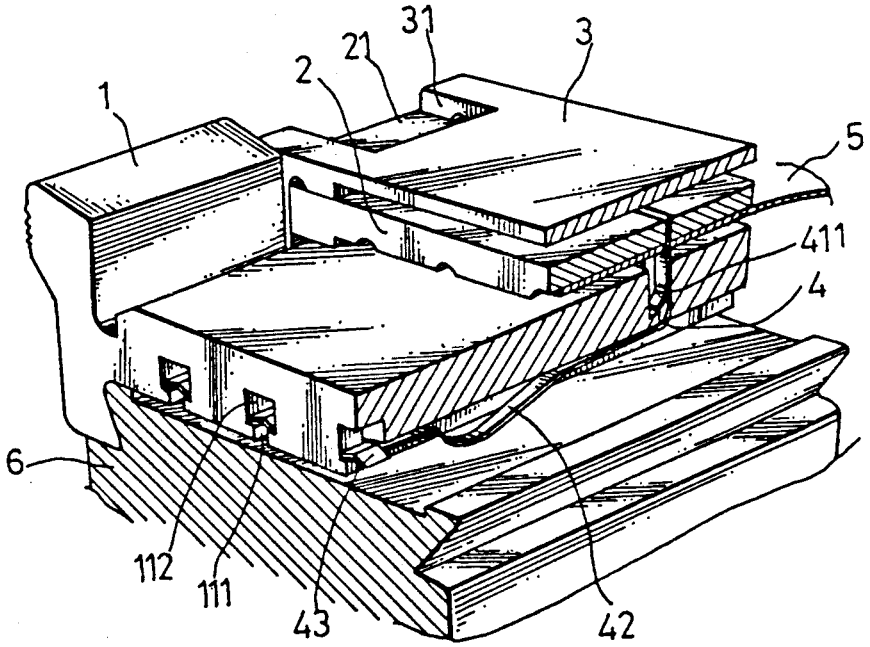
FIG. 5 is a sectional assembly view of the preferred embodiment of the present invention mounted on a bus-bar main track.

The forked end 41 of each conductor of the electrical contact assembly 4 has an unitary stop strip 411 resiliently extending downward outward therefrom at the middle. Therefore, when the electrical contact assembly 4 is attached to the base 1 at the bottom with the forked ends 41 of its conductors respectively inserted through the slots 12 of the base 1 from the bottom, the stop strips 411 of the forked ends 41 are respectively stopped in the slots 12 to firmly retain the forked ends 41 in position. Each conductive spring plate 42 of the conductors of the electrical contact assembly 4 has a inverted V portion 43 at the end opposite to the forked end 41, which is designed to fit into the wider opening 112 at the rear end of each elongated groove 111 (see FIG. 2), Therefore, the electrical contact assembly 4 can be very conveniently fastened in the base 1 at the bottom. After the electrical contact assembly 4 is fastened in the base 1 at the bottom, the four forked ends 41 are disposed to protrude beyond the four slots 12 on the base 1. Therefore, by means of fastening the ribbon cable fastener 2 in the base 1 with the hook portions 21 of the ribbon cable fastener 2 respectively engaged in the two opposite cuts 14, which are made on the bottom edge of the base 1 and disposed respectively in parallel with the two opposite cuts 131 which are made on the two opposite supports 13 at the bottom on the outer side, a ribbon cable 5 can be firmly electrically connected to the forked ends 41 of the electrical contact assembly 4. Referring to FIG. 3, the ribbon cable fastener 2 is placed on the top of the base 1 with its two opposite openings 22 respectively disposed in alignment with the two opposite supports 13 of the base 1, then, press the ribbon cable fastener 2 directly downward permitting the two opposite supports 13 to respectively inserted through the two opposite openings 22 and permitting the two opposite hook portions to respectively engage in the two opposite cuts 131. Thus, the ribbon cable fastener 2 becomes in a ready position for mounting a ribbon cable 5. The ribbon cable 5 to connect is then properly placed on the top of the forked ends 41. Once the ribbon cable fastener 2 is pressed downward further with its two opposite hook portions 21 respectively engaged in the two opposite cuts 14 on the bottom edge of the base 1, the forked ends 41 of the electrical contact assembly 4 are forced to respectively pierce through the ribbon cable 5 permitting the conductors 51 (in the present preferred embodiment, the ribbon cable 5 comprises four conductors) to respectively firmly retained in the fork 412 of the forked ends 41 so as to achieve electrical contact. Because the ribbon cable fastener 2 has two openings 22 corresponding to the two opposite supports 13 on the base 1 and four holes 23 corresponding to the four forked ends 41 of the electrical contact assembly 4 and the four slots 12 on the base 1, it can be conveniently squeezed against the base 1 to fasten a ribbon cable 5 in the electrical contact assembly 4 for electrical contact. After the ribbon cable fastener 2 is attached to the base 1 to electrically fasten a ribbon cable 5 to the electrical contact assembly 4, the stress eliminator 3 is mounted on the ribbon cable fastener 2 and firmly pressed downward permitting its two opposite hook portions 32 to respectively engage in the two opposite cuts 211 on the two opposite hook portions 21 of the ribbon cable fastener 2 and permitting the two opposite hook portions 21 of the ribbon cable fastener 2 to respectively engage in its two opposite openings 31 (see FIG. 4). The base 1 is further fastened on the bus-bar main track 6 by means of its dovetail groove 11 through dovetail joint to electrically connect to the bus-bar main track 6. Thus, the ribbon cable 5 becomes electrically connected to the bus-bar main track 6.

What is claimed is:

1. A structure for a bus-bar type electrical connector, comprising:

a base, having a dovetail groove at a bottom side with a plurality of elongated groves made thereon and longitudinally disposed in parallel with one another, two opposite supports at a top surface with a row of vertical slots defined therebetween, said two opposite supports each having a transverse groove on an outer side at a bottom thereof, said elongated grooves each having an end disposed in communication with said vertical slots and a wider opening at an opposite end, and two stepped edges at two opposite sides respectively in parallel with said transverse groove on said two opposite supports;

an electrical contact assembly integrally comprised of a plurality of conductors respectively fastened in said elongated grooves of said base, said conductors each comprising an elongated, curved, conductive spring plate terminating in a forked end inserted through said slots from the bottom to respectively protrude beyond the top surface of said base, said spring plate having an inverted V portion at an opposite end and respectively retained in the wider opening of said elongated grooves, said forked end having an unitary strip extending downward at a middle region to secure said forked end in said slots:

a ribbon cable fastener, comprising two opposite openings for insertion therethrough of said two opposite supports and a plurality of holes respectively in alignment with said slots, and two opposite hook portions extending downward therefrom at two opposite ends for engaging in either said two transverse grooves on said two opposite supports or said two stepped edges on said base, said two opposite hook portions having each a cut transversely made on an outer wall surface at a bottom thereof;

a stress eliminator being substantially an M-shaped block, having two openings at two opposite ends defining therewith two opposite hook portions transversely disposed at the bottom;

wherein said ribbon cable fastener can be disposed at a ready position with its two opposite hook portions respectively engaged in the two transverse grooves on said two opposite supports for mounting a ribbon cable on top of said forked ends of said electrical contact assembly and firmly squeezed downward against said base permitting said forked ends of said electrical contact assembly to respectively pierce through said ribbon cable so as to respectively firmly retain the conductors in said ribbon cable for electrical contact.

* * * * *